US006694119B2

(12) United States Patent
Rokutanda et al.

(10) Patent No.: US 6,694,119 B2
(45) Date of Patent: Feb. 17, 2004

(54) PERFECTING PRESS APPARATUS

(75) Inventors: Takashi Rokutanda, Ibaraki (JP); Yukio Otome, Ibaraki (JP); Hiroyuki Mabuchi, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/383,062

(22) Filed: Mar. 7, 2003

(65) Prior Publication Data

US 2003/0170052 A1 Sep. 11, 2003

(30) Foreign Application Priority Data

Mar. 8, 2002 (JP) ..... 2002-063931

(51) Int. Cl.[7] ..... G03G 15/16
(52) U.S. Cl. ..... 399/296; 299/300; 299/66
(58) Field of Search ..... 399/66, 296, 297, 399/299, 300, 303, 306, 314, 315

(56) References Cited

U.S. PATENT DOCUMENTS 5,740,508 A * 4/1998 Matsuura et al. ..... 399/308
5,857,135 A * 1/1999 Hayashida et al. ..... 399/296
6,021,302 A * 2/2000 Janssens et al. ..... 399/315

FOREIGN PATENT DOCUMENTS

JP 07-077851 3/1995

* cited by examiner

*Primary Examiner*—Hoang Ngo
(74) *Attorney, Agent, or Firm*—McGinn & Gibb, PLLC

(57) ABSTRACT

A perfecting press apparatus for forming images on both sides of a transfer medium. With respect to a transferring current Ipt of an image forming unit, current Ipc is made large which flows from a charge control instrument for controlling charge polarity of the toner on the transfer medium in the direction of the transfer medium. In particular, in the image forming unit causing retransfer, a de-charging light source is installed between the a developing device and a transferring device for canceling charges other than at a latent image part of an image carrier, so that the relationship between Ipt and Ipc is to be $3\times Ipc \leqq Ipc \leqq 6\times Ipt$, whereby the retransfer is suppressed to minimum for producing satisfied quality of image.

7 Claims, 5 Drawing Sheets

PERFECTING PRESS APPARATUS

BACKGROUND OF THE INVENTION

1. Field of the Invention

The present invention relates to a perfecting press apparatus for forming images on both sides of a transfer medium.

2. Background Art

An electrophotographic system is one of most known printing systems used to copiers or printers. For example, as shown in FIG. 2, in a printing apparatus using a photosensitive drum 1 as an image carrier having a characteristic of charging negative polarity, firstly the photosensitive drum 1 is uniformly charged with negative polarity by a charger 2. Secondly, a light is irradiated by an exposure unit 3 to the photosensitive drum 1 on the basis of image information so as to form an electrostatic latent image, and a toner 5 is supplied to the electrostatic latent image by a developing unit 4 so as to form a toner image on the photosensitive drum 1. The toner image formed on the photosensitive drum 1 is transferred onto the transfer medium 7 such as a paper by a transfer device 6.

In a color image printing apparatus, such a structure has been proposed that, for example, as shown in FIG. 3, there are arranged four image forming units which are provided with the photosensitive drum 1, the charger 2, the exposure unit 3, and the transfer device 6, and the respective image forming units are mounted with developing units 41 to 44 supporting therein different color toners 51 to 54, and the toners of four colors are transferred to the transfer medium 7.

As a structure for printing color images on both sides of the transfer medium, for example, JP-A-7-77851 proposes as shown in FIG. 4, that the image forming units are alternately arranged at both sides holding the transfer medium 7 therebetween for carrying out color image printings.

In this case, immediately before the third image forming unit, a pair of chargers 101*a*, 101*b* are disposed for controlling charging polarity of the toner on the transfer medium 7, and the pair of chargers are disposed upstream of the subsequent respective image forming units. Accordingly, as shown in FIG. 4, in a tandem type printing apparatus for transferring the toners of four colors at one side for perfecting press, six pairs (101*a*, 101*b* to 601*a* and 601*b*) of chargers are required in total.

SUMMARY OF THE INVENTION

However, one of problems involved with the structure of FIG. 4 is that polarity of the toner deposited on the transfer medium 7 is inverted by transferring current of the image forming units for forming images on the opposite side. For example, when using the toner of negative charge, the toner transferred to the transfer medium 7 in the first image forming unit has negative polarity. When forming an image on the opposite side in the second image forming unit, however, the toner transferred to the transfer medium 7 in the first image forming unit turns out the positive charge, since the toner is given a positive charge by a transfer device of the second image forming unit. In case the toner inverted to the positive polarity is introduced into the third image forming unit, positive charges are repulsed in the transferring process of the third image forming unit. Since the toner deposited by the first image forming unit receives power moving toward the photosensitive drum of the third image forming unit, the charge of the toner on the transfer medium 7 must be returned to the negative polarity just before the third image forming unit.

As a method of not using a charge controlling instrument for inverting the charge of the toner on the transfer medium 7, for example, it is sufficient that polarity of the toner forming an image on an upper face and polarity for a rear face are made different. In this case, since the transferring current of the unit forming the image on the rear face has the same charging polarity as that of the toner for the upper face, the polarity of the toner is not inverted. However, two kinds of positive charges and negative charges per four colors must be developed.

There is disclosure in JP-A-7-77851 as to current applied to a charge controlling instrument. According to the Official Gazette, the charge controlling instrument is placed 3 to 10 mm apart from the transfer medium, and the current applied to the charge controlling instrument ranges 1 to 10 $\mu$A/cm (preferably 2 to 5 $\mu$A/cm) in response to properties of papers to be transferred. JP-A-7-77851 also describes as to current applied to the transfer unit, according to which the transfer device is placed 3 to 10 mm apart from the transfer medium, and the current applied to the charge controlling instrument ranges 1 to 10 $\mu$A/cm (preferably 2 to 5 $\mu$A/cm) in response to the properties of the papers to be transferred.

However, no description is made to the relation between current applied to the charge controlling instrument and current to the transfer unit. There can arise a problem in which retransfer phenomenon that the toner on the transfer medium returns to the photosensitive drum becomes remarkable.

Assuming that currents applied to the transfer device and the charge controlling instrument are Itt and Itc, and currents flowing owing to discharge therefrom in the direction toward the transfer medium are Ipt and Ipc, Ipt and Ipc contribute to transfer or charging of the toner on the transfer medium are.

Accordingly, it is an object of the invention to offer a perfecting press apparatus, enabling to suppress to a minimum the retransfer phenomenon that the toner on the transfer medium returns to the image carrier as the photosensitive drum.

To achieve the object, the invention provides a perfecting press apparatus, which includes: at least a first image forming unit, a second image forming unit and a third image forming unit; and a charge controlling unit of corona discharging type.

Each of the first, second and third image forming units includes: an image carrier; a charging unit for evenly charging the image carrier; an exposure unit for making image exposure on the charged image carrier on the basis of image information to thereby form an electrostatic latent image on the image carrier; a developing unit for supplying developer to the image carrier holding electrostatic latent image to thereby form a toner image on the image carrier; and a transfer unit of corona discharging type for transferring the toner image formed on the image carrier to a transfer medium.

The image carriers of the first image forming unit, the second image forming unit and the third image forming unit are alternately arranged at both sides of the transfer medium.

The charge controlling unit controls charging polarities of the toner images formed on both faces of the transfer medium by the first and second image forming units before the transfer medium is sent to the third image forming unit.

An absolute value of current flowing from the charge controlling unit in the direction of the transfer unit is made larger than an absolute value of current flowing from the transfer unit of the third image forming unit in the direction of the transfer medium.

BRIEF DESCRIPTION OF THE DRAWINGS

The present invention may be more readily described with reference to the accompanying drawings, in which.

DETAILED DESCRIPTION OF THE PREFERRED EMBODIMENTS

EXAMPLE 1

Explanation will be made to Examples of the invention with reference to the attached drawings. The following explanation will exemplify a printing apparatus by an inversion developing system using a negative charged toner, but a case of using a positive charged toner is also applicable. Further, it is unnecessary to say that the printing apparatus can be applied to a printing apparatus by a normal developing system.

Figure 1:
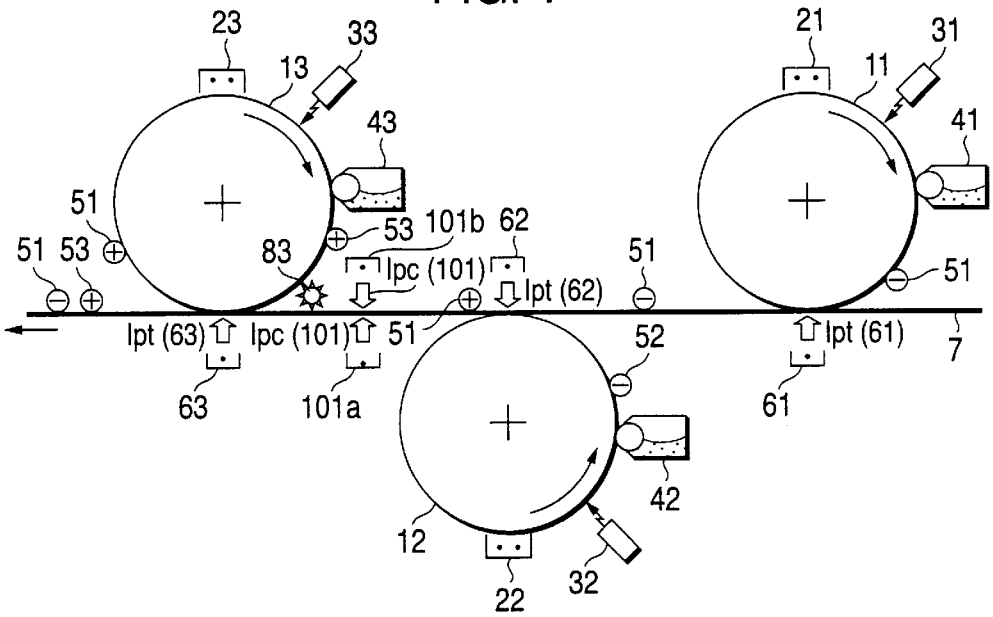
FIG. 1 is a schematic view showing an example of the invention.
Figure 2:
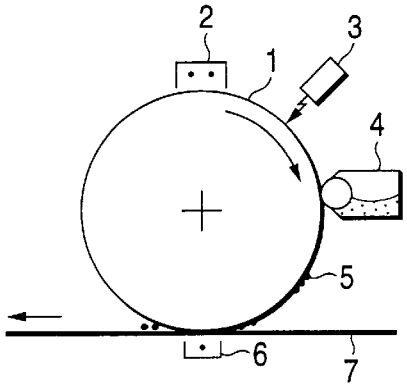
FIG. 2 is a schematic view showing an ordinary printing apparatus.
Figure 3:
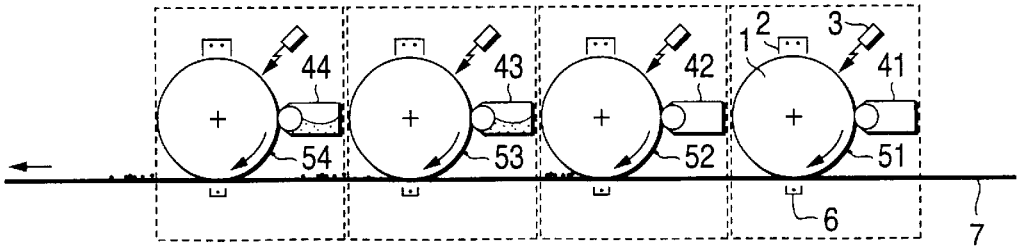
FIG. 3 is a schematic view showing one example of a color printing apparatus.
Figure 4:
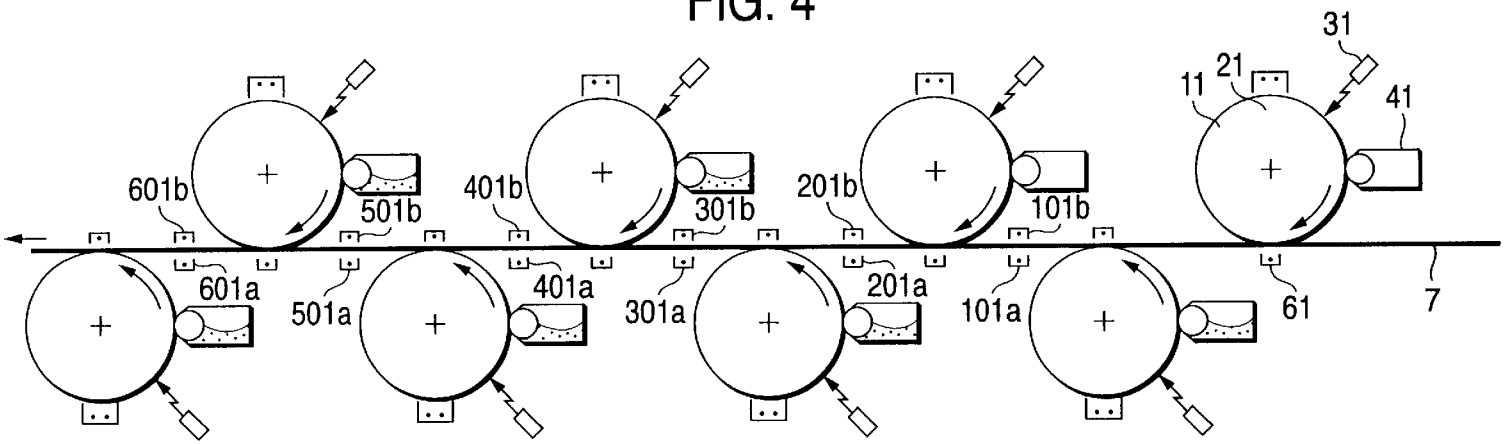
FIG. 4 is a schematic view showing one example of perfecting color press apparatus.

FIG. 1 is a view showing the first to third image forming units in the tandem type perfecting press apparatus as shown in FIG. 4. The photosensitive drums 11, 12 and 13 of the respective image forming units can rotate at speed of 40 cm/s to 100 cm/s and have organic sensitive layers on the surfaces. The photosensitive drums are evenly charged, e.g., around −700 V by chargers 21, 22 and 23 of corotron or scorotron. Exposure units 31, 32 and 33 apply image exposures to the surfaces of the photosensitive drum 11, 12 and 13 on the basis of image information so as to form electrostatic latent images. Each of the exposure units 31, 32 and 33 includes laser beam of scanning type or LED array (the present example uses LED array of 765 nm). A range of available wavelength depends on spectra sensitivity of photoconductor. The photoconductor of this Example has spectra sensitivity of around $1.0\times10^3$ V/μj/cm$^2$ for light of 600 to 900 nm. An electrostatic latent image is developed by the toners 51, 52, 53 supplied from the developing units 41, 42, and 43. In this Example, the toners 51 and 52 are a yellow toner, and 53 is a magenta toner, but the advantage of the present invention is not limited to this embodiment.

Figure 5:
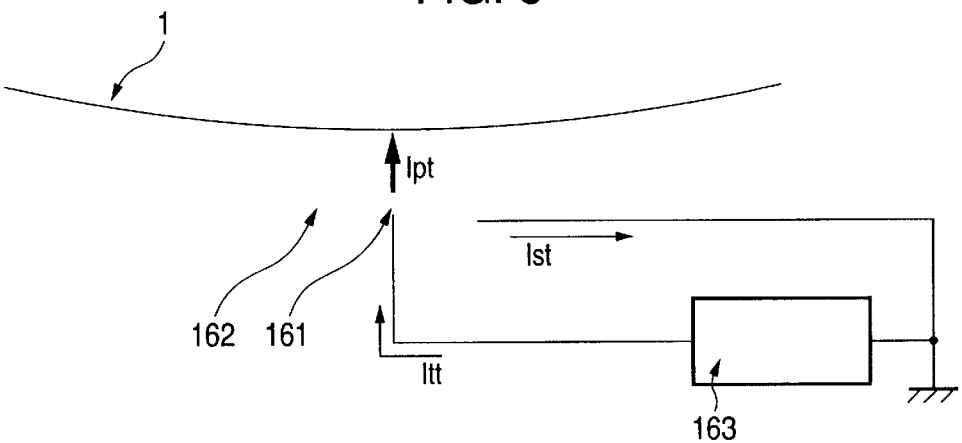
FIG. 5 is a view for explaining definition of transferring current.

After developing, the respective toners 51, 52 and 53 are transferred to the transfer medium 7 by transfer devices 61, 62 and 63 of the respective units. The transfer devices 61, 62 and 63 are encircled with a metal plate 162 grounded with a discharge wire 161 as shown in FIG. 5. Current values Itt applied to the discharge wire are roughly divided into current Ipt flowing in the direction toward the photoconductor and current Ist flowing in the direction of the metal plate 162. Transferring current referred to herein designates Ipt.

Ipt (61), Ipt (62), Ipt (63) shown in FIG. 1 are current components flowing in the direction of the, photoconductor, that is, transferring currents. By the way, a later mentioned charge-controlling instrument is also the same as the transfer device. The toner remaining on the photoconductor is cleansed by a cleaning instrument such as a brush or a plate like blade, but not shown in FIG. 1.

Now noting the toner 51, while passing the transfer device 62 of the second image forming unit (called as "second unit" hereafter), the toner 51 takes a positive value or near to 0 (zero) by positive charge issued from the transfer device 62. A pair of chargers 101*a* and 101*b* serving as the charge controlling instrument are instruments for returning the positive toner to negative, and 101*a* is dc positive discharge and 101*b* is dc negative discharge.

Absolute values Ipc (101) of current flowing in the direction of the transfer medium are the same. The toners 51 of charging polarity returned to negative by the chargers 101*a*, 101*b* contact the photoconductor 13 in the transferring process of the third image forming unit (called as "third unit" hereafter). At this time, there occurs a retransferring phenomenon that a part of the toner 51 goes back to the photoconductor 13, and this rate is defined as η%. As one of instruments for reducing η, a de-charging light source 83 is installed between the developing unit 43 of the third unit and the transfer device 63 for de-charging electricity from the allover surfaces of the photoconductor 13.

The de-charging light source is also installed for six image forming units following the third unit. The first and second units caused with no retransfer do not always require it. The wavelength of the de-charging light source 83 is enough with 600 to 900 nm, and the present example employs LED array of 700 nm. The de-charging light source may be a fluorescent lamp, for which a filter is installed between the fluorescent lamp and the photoconductor, which filter passes specific wavelength. A potential of the photoconductor is set such that it is −60 to −70 V at the transferring part by the de-charging light source 83.

Figure 6:
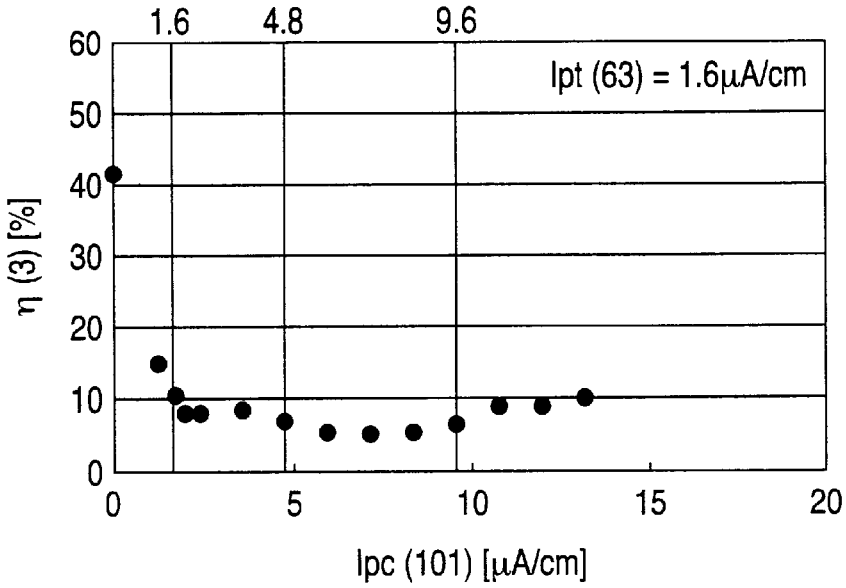
FIG. 6 is a graph for explaining the relationship between charge controlling current and the retransferring rate.
Figure 7:
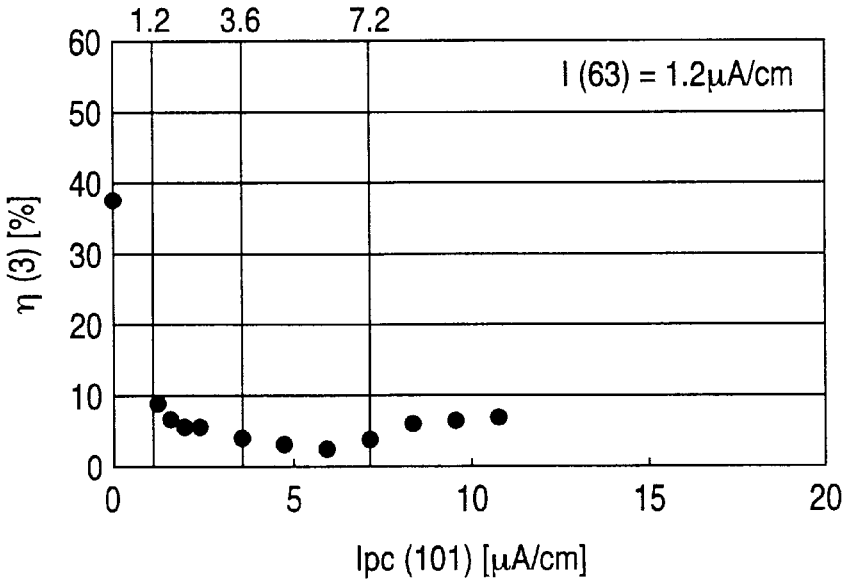
FIG. 7 is a graph for explaining the relationship between charge controlling current and the retransferring rate.
Figure 8:
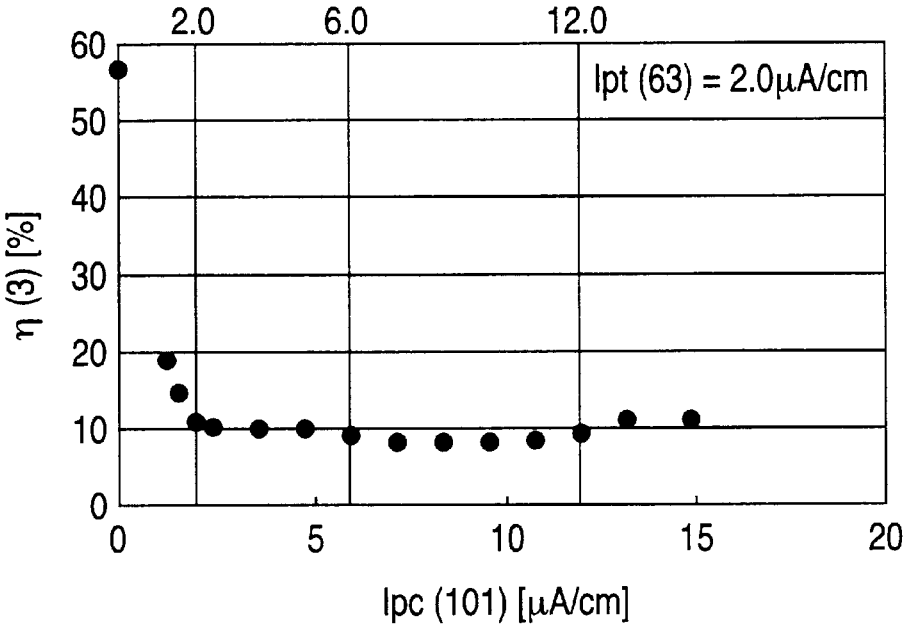
FIG. 8 is a graph for explaining the relationship between charge controlling current and the retransferring rate.

Herein, FIGS. 6, 7 and 8 are referred to. FIG. 6 is a graph showing relationship between Ipc (101) and η (3) when Ipt (63)=1.6 μA/cm. When Ipt (63)≦Ipc (101), η (3) falls short of 11%. In particular, when Ipc (101) is 3 to 6 times of Ipc (63), η (3) becomes minimum, and degree of deterioration in quality of image is smaller than any other conditions.

FIG. 7 is a graph showing the relationship between Ipc (101) and η (3) when Ipt (63)=1.2 μA/cm. When Ipt (63) ≦Ipc (101), η (3) falls short of 10%. In particular, when Ipc (101) is 3 to 6 times of Ipc (63), η (3) becomes minimum, and degree of deterioration in quality of image is smaller than any other conditions.

FIG. 8 is a graph showing the relationship between Ipc (101) and η (3) when Ipt (63)=2.0 μA/cm. When Ipt (63) ≦Ipc (101), η (3) falls short of 12%. In particular, when Ipc (101) is 3 to 6 times of Ipc (63), η (3) becomes minimum, and degree of deterioration in quality of image is smaller than any other conditions.

Even if changing the transferring current Ipt (63) of the third unit, if keeping the current value Ipc of the chargers

101*a*, 101*b* 3 to 6 times of Ipt, η is minimum, and degree of deterioration in quality of image can be made smallest. As seen from FIGS. 6, 7 and 8, when Ipc is constant, η is made small by setting Ipc to be small, but a transferring efficiency of the toner 53 is also small. Ipt may be determined to be an arbitrary value, but this is desirably determined, taking a balance between the transferring efficiency of the toner 53 and η into consideration.

Working effects of the invention are effective to not only the third unit but also all of units caused with the retransfer phenomenon.

EXAMPLE 2

As mentioned in Example 1, it is desirable that Ipt is determined, taking the balance between the transferring efficiency of the toner 53 (herein, magenta toner) and η into consideration. One of manners therefor will be explained in Example 2.

Figure 9:
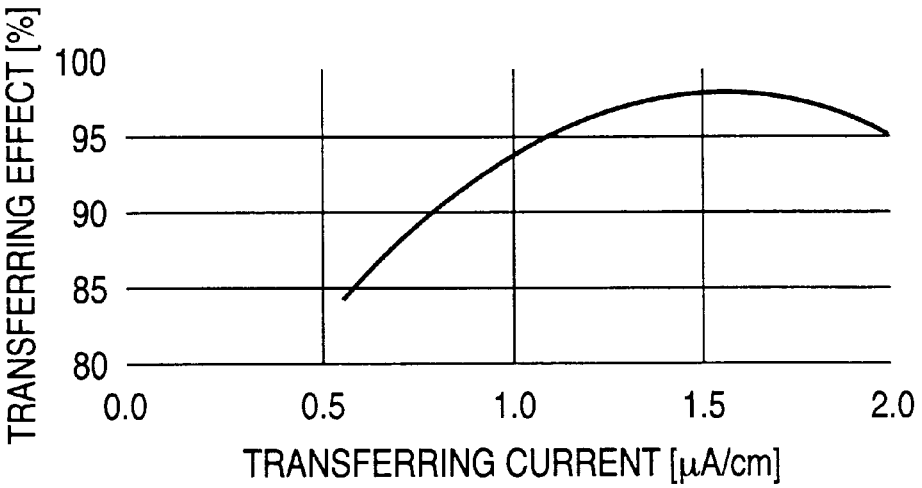
FIG. 9 is a view for explaining the transferring rate of a yellow toner.
Figure 10:
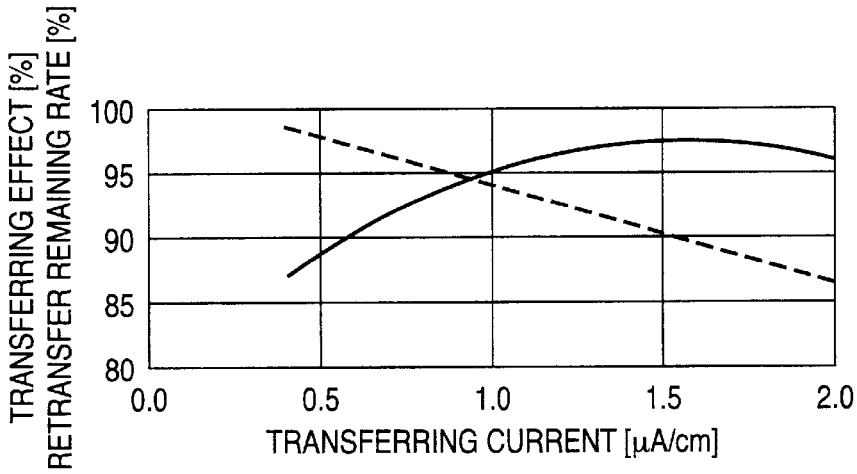
FIG. 10 is a view for explaining the relationship between the transferring efficiency of magenta toner and the retransferring remaining rate of the yellow toner after having passed a second unit.

FIG. 9 is an explanatory view showing the relationship between the transferring current and the transferring effect when printing solid of images of the yellow toner used for a first coloring, and FIG. 10 is an explanatory view showing the relationship between the transferring effect (solid line) when printing solid of images of the magenta toner used for a second coloring and the retransfer remaining rate (dotted line) when printing solid of images of the yellow toner after having passed the third unit. Herein, the retransfer remaining rate is defined as a rate of the toner amount remaining on the transfer medium vs. a developing amount remaining on the transfer medium after the toner once transferred on the transfer medium has returned to the photoconductor of the image forming unit for forming an image of another color by the retransfer phenomenon.

The amount of the yellow toner returning from the transfer medium 7 to the photoconductor 13 by the retransfer phenomenon depends on the transcription current Ipt, and it is seen that the retransfer remaining rate of the yellow toner after having passed the third unit as shown in FIG. 10 decreases together with Ipt. Accordingly, if using the transcription current at a crossing point of both curves of FIG. 10 by adjusting almost constantly the developing amounts in the respective units, it is seen that the weight of the magenta toner transferred to the transfer medium in the third unit and the weight of the yellow toner on the transfer medium after the toner has been deprived by the retransfer phenomenon can be equalized even after having passed the third unit.

The same may be applied to the fifth and seventh units as well as to the sixth and eight units. If the transferring currents in the respective units are determined, taking the balance between the transferring efficiency and retransfer remaining rate into consideration, the weights of the toners of the respective colors can be maintained almost equal.

EXAMPLE 3

In FIG. 1, in case the de-charging light source 83 of the third unit is removed, if making Ipc>Ipt, preferably $3\times Ipc \leqq Ipc \leqq 6\times Ipt$, η can be reduced to minimum even in a system removing the de-charging light source 83. At this time, potentials of the image carriers other than the latent image part are around −670 V. But being without the de-charging light source, η is larger than a case of being presence of the de-charging light source.

EXAMPLE 4

In FIG. 1, even if using, as the de-charging light source, LED arrays of 600, 630, 660, and 670 nm, similar effects to that of the Example 1 are brought about. In addition, even if light of the fluorescent lamp is passed through the respective filters, similar effects are obtained. Herein, the fluorescent lamp is an ordinarily use done, for example, FL15W made by Hitachi, Ltd. is one of examples thereof. Further, the filter is such filters of not passing light being basically less than 600 nm, and no problem is involved with filters passing more than 600 nm, and the same effect as in Example 1 can be expected by, for example, Sharp Cut Filter of optical filters made by Fuji Film Co., Ltd., SC-60, SC-62, SC-64, SC-66, SC-68, SC-70, SC-72, or SC-74, or Special Purpose Filter SP-3 of optical filters made by Fuji Film Co., Ltd.

Figure 11:
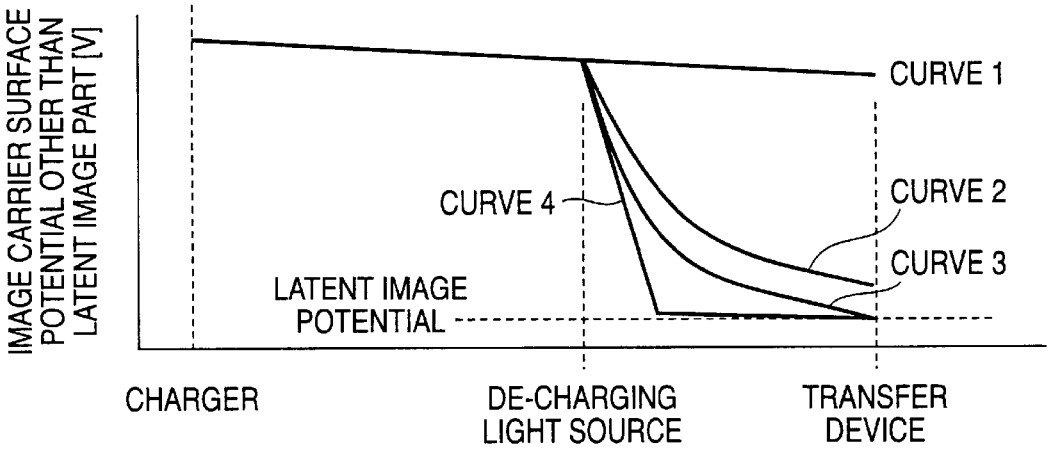
FIG. 11 is a view for explaining fluctuations of potential of image carriers.

Quantity of light is not especially determined. In case the de-charging light source 83 is not used as shown in FIG. 11, the nearer to 0V the potential becomes than the potential of the transferring part being −670 (curve 1), η can be reduced so much. For example, no matter happens if the potential of the photoconductor at the transferring part is not equivalent to the potential at the latent image as a curve 2. Preferably, the potential is −60 to −70 V at the transferring part (curve 3), and if being −60 to −70 V before getting into the transferring part (curve 4), scattering of the toner on the photoconductor is remarkable. In short, varied is optimum quality of light used by a distance from the de-charging light source till the transferring part and the rotating speed of the photoconductor.

Quality of light may be adjusted in dependence on changing of LED or output of the fluorescent lamp, or using of a filter absorbing light at a fixed rate as Neutral Density Filter of optical filter made by Fuji Film Co., Ltd.

As having mentioned above, for suppressing the retransfer phenomenon, Ipc>Ipt is made to the relationship between the transferring current Ipt of the image forming unit caused with the retransfer phenomenon and the charge controlling current Ipc of the charge controlling instrument installed immediately before the image forming unit. In particular, the de-charging light source is provided for de-charging the image carrier between the developing instrument of the image forming unit and the transferring instrument caused with the retransfer phenomenon, and the relationship of $3\times Ipc \leqq Ipc \leqq 6\times Ipt$ is satisfied, so that the rate η of the toner returning to the image carrier by the retransfer phenomenon can be controlled to be minimum, enabling to suppress deterioration in quality of image to be minimum.

What is claimed is:

1. A perfecting press apparatus, comprising:

at least a first image forming unit, a second image forming unit and a third image forming unit; and a charge controlling unit of corona discharging type;

wherein each of the first, second and third image forming units includes: an image carrier; a charging unit for evenly charging the image carrier; an exposure unit for making image exposure on the charged image carrier on the basis of image information to thereby form an electrostatic latent image on the image carrier; a developing unit for supplying developer to the image carrier holding electrostatic latent image to thereby form a toner image on the image carrier; and a transfer unit of corona discharging type for transferring the toner image formed on the image carrier to a transfer medium;

the image carriers of the first image forming unit, the second image forming unit and the third image forming unit are alternately arranged at both sides of the transfer medium;

the charge controlling unit controls charging polarities of the toner images formed on both faces of the transfer medium by the first and second image forming units before the transfer medium is sent to the third image forming unit;

an absolute value of current flowing from the charge controlling unit in the direction of the transfer unit is made larger than an absolute value of current flowing from the transfer unit of the third- image forming unit in the direction of the transferring medium.

2. The perfecting press apparatus as claimed in claim 1, wherein, when the absolute value of current flowing from the charge controlling unit to the transfer medium is Ipc and the absolute value of current flowing from the transfer unit of the third image forming unit to the transfer medium is Ipt, Ipc and Ipt satisfy a condition of $3 \times Ipc \leqq Ipc \leqq 6 \times Ipt$.

3. The perfecting press apparatus as claimed in claim 1, wherein the third image forming includes a de-charging light source for canceling electric charge of the image carrier; and the de-charging light source is disposed between the developing unit and the transfer unit of the third image forming unit.

4. The perfecting press apparatus as claimed in claim 3, wherein the de-charging light source is a fluorescent lamp or an LED array.

5. The perfecting press apparatus as claimed in claim 3, wherein a wavelength of maximum intensity lighted by the de-charging light source is 600 nm or more.

6. The perfecting press apparatus as claimed claim 3, wherein quantity of exposure light of the de-charging light source is determined such that potential of a portion of the image carrier is made substantially unequal to potential of a latent image portion of the image carrier by light emitted from the de-charging light source before potential of the portion of the image carrier enters into a transfer part where the toner image is transferred to the transfer medium by the transfer unit.

7. The perfecting press apparatus as claimed in claim 1, wherein the third image forming unit is positioned at downstream to the first and second image forming unit;

value of transfer current of the transfer unit in the respective image forming units is determined on the basis of a first proportion and a second proportion;

the first proportion is the proportion of quantity of toner in the toner image on the image carrier to quantity of toner in the toner image transferred to the transfer medium;

the second proportion is the proportion of quantity of toner remaining on the transfer medium after the toner is once transferred to the transfer medium at one of the first and second image forming unit and then a part of the toner returns to the image carrier of the third image forming unit, to quantity of toner in the toner image on the image carrier of the one of the first and second image forming unit.

* * * * *